US005388138A

United States Patent [19]

Fujiwara

[11] Patent Number: 5,388,138

[45] Date of Patent: Feb. 7, 1995

[54] X-RAY DIAGNOSTIC APPARATUS

[75] Inventor: Shigemi Fujiwara, Tochigiken, Japan

[73] Assignee: Kabushiki Kaisha Toshiba, Kanagawa, Japan

[21] Appl. No.: 157,278

[22] Filed: Nov. 26, 1993

[30] Foreign Application Priority Data

Nov. 27, 1992 [JP] Japan ..... 4-317586

[51] Int. Cl.[6] ..... H05G 1/42

[52] U.S. Cl. ..... 378/108; 378/110; 378/112; 378/98.7

[58] Field of Search ..... 378/98, 98.2, 98.4, 378/98.7, 98.8, 108, 110, 97, 109, 111, 112

[56] References Cited

U.S. PATENT DOCUMENTS 5,187,730 2/1993 Fujihara ..... 378/108

FOREIGN PATENT DOCUMENTS 61-145972 7/1986 Japan .

*Primary Examiner*—David P. Porta

*Attorney, Agent, or Firm*—Finnegan, Henderson, Farabow, Garrett & Dunner

[57] ABSTRACT

An X-ray diagnostic apparatus includes: an X-ray tube; an X-ray controller for controlling a dose of X-rays generated by the X-ray tube; an image intensifier for converting X-rays radiated by the X-ray tube and passed through an object to be diagnosed, into an optical image; an optical system through which the optical image is passed; an image forming device for transducing the optical image obtained through the optical system into electric signals, the image forming device being provided with Knee characteristics such that photoelectric transduction characteristics into the electric signals has a point of inflection beyond which gradient thereof is reduced; a memory device for storing the electric signals outputted by the image forming device; an image displaying unit for processing the electric signals of the memory device for display of diagnosis information of the object to be diagnosed; an interest region determining section for determining a region of interest with respect to the diagnosis information displayed on the image display unit; and a luminous energy control section for controlling the dose of the X-rays through the X-ray controller on the basis of pixel values of the image forming device obtained in the determined region of interest, in such a way that values on the photoelectric transduction characteristics are always kept lower than a value at the point of inflection.

12 Claims, 3 Drawing Sheets

X-RAY DIAGNOSTIC APPARATUS

BACKGROUND OF THE INVENTION

The present invention relates to an X-ray diagnostic apparatus.

In an X-ray diagnostic apparatus, halation of a fluoroscopic and/or photographic image is a phenomenon caused by an image forming device (camera tube) when luminous energy (a quantity of light) increases in a region at which the X ray absorption rate is extremely small in the vicinity of an area to be observed, in spite of the fact that the luminance (brightness) of an object to be observed is appropriately adjusted. To prevent this halation, conventionally, a method of using compensation filters (containing an X-ray absorbing substance) has been so far adopted. In this method, the compensation filters are previously prepared on the basis of some standard halation patterns. In more detail, the compensation filters are formed on the basis of a plurality of standard patterns according to the site to be diagnosed. When having recognized the presence of a halation in a monitor image, the operator inserts an appropriate compensation filter into an illumination field at the front of an X-ray tube by manipulating a compensation filter control device. In this case, the operator controls the location of the compensation filter by watching the halation in the monitor image and the compensation filter inserted into the Illumination field, In such a way that the halation can be eliminated most effectively and thereby the image can be observed most clearly. In this halation prevention method, since a dose of the X-rays radiated upon an object to be diagnosed is reduced at only the region where the compensation filter is inserted, as compared with the other region, the dose of the X-rays incident upon the camera tube can be reduced at the halation portion.

In the above-mentioned conventional method, however, since the previously determined pattern of the compensation filter does not necessarily match the shape of the actual halation, there exists a problem in that it is impossible to eliminate halation perfectly. Further, since the compensation filter formed of an X-ray absorbing substance is additionally inserted into the image, the compensation filter is also displayed as an image, thus resulting in shortcomings such that there exists a possibility of erroneous diagnosis because the operator mistakes a shadow of the compensation filter for a shadow of an object to be diagnosed. Further, whenever halation occurs, since the operator must insert the compensation filter and further adjust the location of the compensation filter, there exists another problem in that the diagnosis operation is complicated and therefore it takes a long time for the diagnosis.

SUMMARY OF THE INVENTION

With these problems in mind, therefore, it is the object of the present invention to provide an X-ray diagnostic apparatus which can prevent halation without use of any compensation filter.

The feature of the X-ray diagnostic apparatus according to the present invention is to adopt an image forming device such as CCD of two-stage gain (Knee) characteristics. In this two-gain characteristics, the photoelectric transduction characteristics of the CCD can be controlled in such a way that the output signal level of the CCD increases linearly at a relatively sharp gradient in response to the low luminous energy (quantity) of light allowed to be incident upon the CCD, but at a relatively gentle gradient in response to the high luminous energy of the light when the luminous energy exceeds a point of inflection.

To achieve the above-mentioned object, the present invention provides an X-ray diagnostic apparatus comprising: an X-ray tube; an X-ray controller for controlling a dose of X-rays generated by said X-ray tube; an image intensifier for converting X-rays radiated by said X-ray tube and passed through an object to be diagnosed, into an optical image; an optical system through which the optical image is passed; an image forming device for transducing the optical image obtained through said optical system into electric signals, said image forming device being provided with Knee characteristics such that photoelectric transduction characteristics into the electric signals has a point of inflection beyond which gradient thereof is reduced; a memory device for storing the electric signals outputted by said image forming device; an image displaying unit for processing the electric signals of said memory device for display of diagnosis information of the object to be diagnosed; interest region determining means for determining a region of interest with respect to the diagnosis information displayed on said image display unit; and luminous energy control means for controlling the dose of the X-rays through said X-ray controller on the basis of pixel values of said image forming device obtained in the determined region of interest, in such a way that values on the photoelectric transduction characteristics are always kept lower than a value at the point of inflection.

Further, the present invention provides an X-ray diagnostic apparatus comprising: an X-ray tube; an X-ray controller for controlling a dose of X-rays generated by said X-ray tube; an image intensifier for converting X-rays radiated by said X-ray tube and passed through an object to be diagnosed, into an optical image; an optical system having an optical diaphragm, through which the optical image is passed; an image forming device for transducing the optical image obtained through said optical system into electric signals, said image forming device being provided with Knee characteristics such that photoelectric transduction characteristics into electric signals has a point of inflection beyond which gradient thereof is reduced; a memory device for storing the electric signals outputted by said image forming device; an image displaying unit for processing the electric signals of said memory device for display of diagnosis information of the object to be diagnosed; interest region determining means for determining a region of interest with respect to the diagnosis information displayed on said image display unit; and luminous energy control means for controlling luminous energy of light incident upon said image forming device through the optical diaphragm on the basis of pixel values of said image forming device obtained in the determined region of interest, in such a way that values on the photoelectric transduction characteristics are always kept lower than a value at the point of inflection.

Further, the present invention provides an X-ray diagnostic apparatus comprising: an X-ray tube; an X-ray controller for controlling a dose of X-rays generated by said X-ray tube; an image intensifier for converting X-rays radiated by said X-ray tube and passed through an object to be diagnosed, into an optical image; an optical system having an optical diaphragm, through which the optical image is passed; an image forming device for transducing the optical image obtained through said optical system into electric signals, said image forming device being provided with Knee characteristics such that photoelectric transduction characteristics into electric signals has a point of inflection beyond which gradient thereof is reduced; a memory device for storing the electric signals outputted by said image forming device; an image displaying unit for processing the electric signals of said memory device for display of diagnosis information of the object to be diagnosed; interest region determining means for determining a region of interest with respect to the diagnosis information displayed on said image display unit; and luminous energy control means for controlling the dose of the X-rays through said X-ray controller and further luminous energy of light incident upon said image forming device through the optical diaphragm on the basis of pixel values of said image forming device obtained in the determined region of interest, in such a way that values on the photoelectric transduction characteristics are always kept lower than a value at the point of inflection.

Further, in the preferred embodiments of the present invention, the image forming device is a charge coupled device.

In the X-ray diagnostic apparatus according to the present invention, when the image forming device having no Knee characteristics as shown by the dashed line A in FIG. 2 is used, image data can be read and displayed on the monitor clearly without halation only when the dose of the X-rays ranges from 0 to $I_{max}$, but with halation when the dose of the X-rays exceeds $I_{max}$. In contrast with this, in the X-ray diagnostic apparatus according to the present invention, since the apparatus is provided with the image forming device having the Knee characteristics as shown by the solid line B in FIG. 2, the image data can be read and displayed on the monitor clearly without halation in such a wide range as from 0 to $I_{max}$.

Further, since a dose of the X-ray radiated by the X-ray tube is controlled by the X-ray controller in response to a control signal applied by the luminous energy control means on the basis of the pixel values of the image forming device obtained at the determined region of interest, it is possible to control the apparatus in such a way that values on the Knee characteristics corresponding to the pixel values in the region of interest are always kept lower than a value at the point of inflection.

Further, In the diagnostic apparatus of the present invention, since the optical system is provided with the optical diaphragm, the luminous energy of light allowed to be incident upon the image forming device can be controlled by adjusting the aperture rate of the optical diaphragm (without controlling the dose of the X-rays radiated by the X-ray tube) in response to a control signal applied by the luminous energy control means on the basis of the pixel values of the image forming device obtained at the determined region of interest, in such a way that values on the Knee characteristics corresponding to the pixel values in the region of interest are always kept lower than a value at the point of inflection.

In the preferred embodiment, the luminous energy control means can transmit the control signals to the X-ray controller on the basis of the average pixel values in the region of interest, so that the dose of the X-rays radiated by the X-ray tube can be controlled by the X-ray controller in response to the control signals. Therefore, it is possible to control the luminous energy (quantity) of light allowed to be incident upon the image forming device by adjusting the dose of the X-rays under the condition that the optical diaphragm is kept at a constant aperture or by adjusting the aperture of the optical diaphragm under the condition that the X-rays are kept at a constant dose or adjusting both the dose of the X-rays and the aperture of the optical diaphragm, in such a way that values on the Knee characteristics corresponding to the pixel values in the region of interest are always kept lower than a value at the point of inflection.

Further, when the charge coupled device is used as the image forming device, since it is easy to control the device so as to have the Knee characteristics, the configuration of the diagnostic apparatus can be simplified.

Further, the other aspect of the present invention provides an X-ray diagnostic apparatus comprising: an X-ray tube; an X-ray controller for controlling a dose of X-rays generated by said X-ray tube; an image intensifier for converting X-rays radiated by said X-ray tube and passed through an object to be diagnosed, into an optical image; an optical system through which the optical image is passed; an image forming device for transducing the optical image obtained through said optical system into electric signals; a Knee characteristic processing section for providing Knee characteristics such that input/output characteristics thereof has a point of inflection beyond which gradient thereof is reduced, to the electric signals outputted by said image forming means; a memory device for storing the electric signals outputted by said Knee characteristic processing section; an image displaying unit for processing the electric signals of said Knee characteristic processing section for display of diagnosis information of the object to be diagnosed; interest region determining means for determining a region of interest with respect to the diagnosis information displayed on said image display unit; and luminous energy control means for controlling the dose of the X-rays through said X-ray controller on the basis of pixel values of said image forming device obtained in the determined region of interest, in such a way that values of the electric signals to which the Knee characteristics are provided are always kept lower than a value at the point of inflection.

Further, the other aspect of the present invention provides an X-ray diagnostic apparatus comprising: an X-ray tube; an X-ray controller for controlling a dose of X-rays generated by said X-ray tube; an image intensifier for converting X-rays radiated by said X-ray tube and passed through an object to be diagnosed, into an optical image; an optical system having an optical diaphragm, through which the optical image is passed; an image forming device for transducing the optical image obtained through said optical system into electric signals; a Knee characteristic processing section for providing Knee characteristics such that input/output characteristics thereof has a point of inflection beyond which gradient thereof is reduced, to the electric signals outputted by said image forming means; a memory device for storing the electric signals outputted by said Knee characteristic processing section; an image displaying unit for processing the electric signals of said Knee characteristic processing section for display of diagnosis information of the object to be diagnosed; interest region determining means for determining a region of interest with respect to the diagnosis information displayed on said image display unit; and luminous energy control means for controlling luminous energy of light incident upon said image forming device through the optical diaphragm on the basis of pixel values of said image forming device obtained in the determined region of interest, in such a way that values of the electric signals to which the Knee characteristics are provided are always kept lower than a value at the point of inflection.

Further, the other aspect of the present invention provides an X-ray diagnostic apparatus comprising: an X-ray tube; an X-ray controller for controlling a dose of X-rays generated by said X-ray tube; an image intensifier for converting X-rays radiated by said X-ray tube and passed through an object to be diagnosed, into an optical image; an optical system having an optical diaphragm, through which the optical image is passed; an image forming device for transducing the optical image obtained through said optical system into electric signals; a Knee characteristic processing section for providing Knee characteristics such that input/output characteristics thereof has a point of inflection beyond which gradient thereof is reduced, to the electric signals outputted by said image forming means; a memory device for storing the electric signals outputted by said Knee characteristic processing section; an image displaying unit for processing the electric signals of said Knee characteristic processing section for display of diagnosis information of the object to be diagnosed; interest region determining means for determining a region of interest with respect to the diagnosis information displayed on said image display unit; and luminous energy control means for controlling the dose of the X-rays through said X-ray controller and further luminous energy of light incident upon said image forming device through the optical diaphragm on the basis of pixel values of said image forming device obtained in the determined region of interest, in such a way that values of the electric signals to which the Knee characteristics are provided are always kept lower than a value at the point of inflection.

In the X-ray diagnostic apparatus of the above-mentioned construction, since the Knee characteristic processing section is provided, it is possible to prevent the halation effectively in quite the same way as with the case of the first aspect of the present invention.

In the X-ray diagnostic apparatus according to the present invention, the halation can be prevented securely without use of any compensation filter, so that the diagnosis efficiency can be improved. Further, since no compensation filter is used, it is possible to prevent erroneous diagnosis by mistaking a shadow of the object to be diagnosed for a shadow of the compensation filter or confuse a shadow of the object with a shadow of the compensation filter. Further, since no compensation filter is used, it is possible to reduce the burden to the operator without need of insertion and positional adjustment of the compensation filter and further to shorten the inspection time. In addition, since no compensation filter driving and control sections are required, it is possible to simplify the configuration of the diagnostic apparatus, as compared with the conventional diagnostic apparatus.

DETAILED DESCRIPTION OF THE PREFERRED EMBODIMENTS

The first embodiment of the X-ray diagnostic apparatus according to the present invention will be described hereinbelow with reference to FIG. 1.

Prior to the detailed description thereof, Knee characteristics will be first described. Japanese Published Unexamined (Kokai) Patent Application 61-145972 discloses a CCD (charge coupled device) of two-stage gain characteristics. In this CCD, the photoelectric transduction characteristics can be controlled in such a way that the output signal level of the CCD increases linearly at a relatively sharp gradient in response to the low luminous energy (quantity) of light allowed to be incident upon the CCD, but at a relatively gentle gradient in response to the high luminous energy of the light when the luminous energy exceeds a point of inflection. In the X-ray diagnostic apparatus according to the present invention, the image forming device (CCD) is also controlled in accordance with the above-mentioned two-stage gain characteristics.

Figure 1:
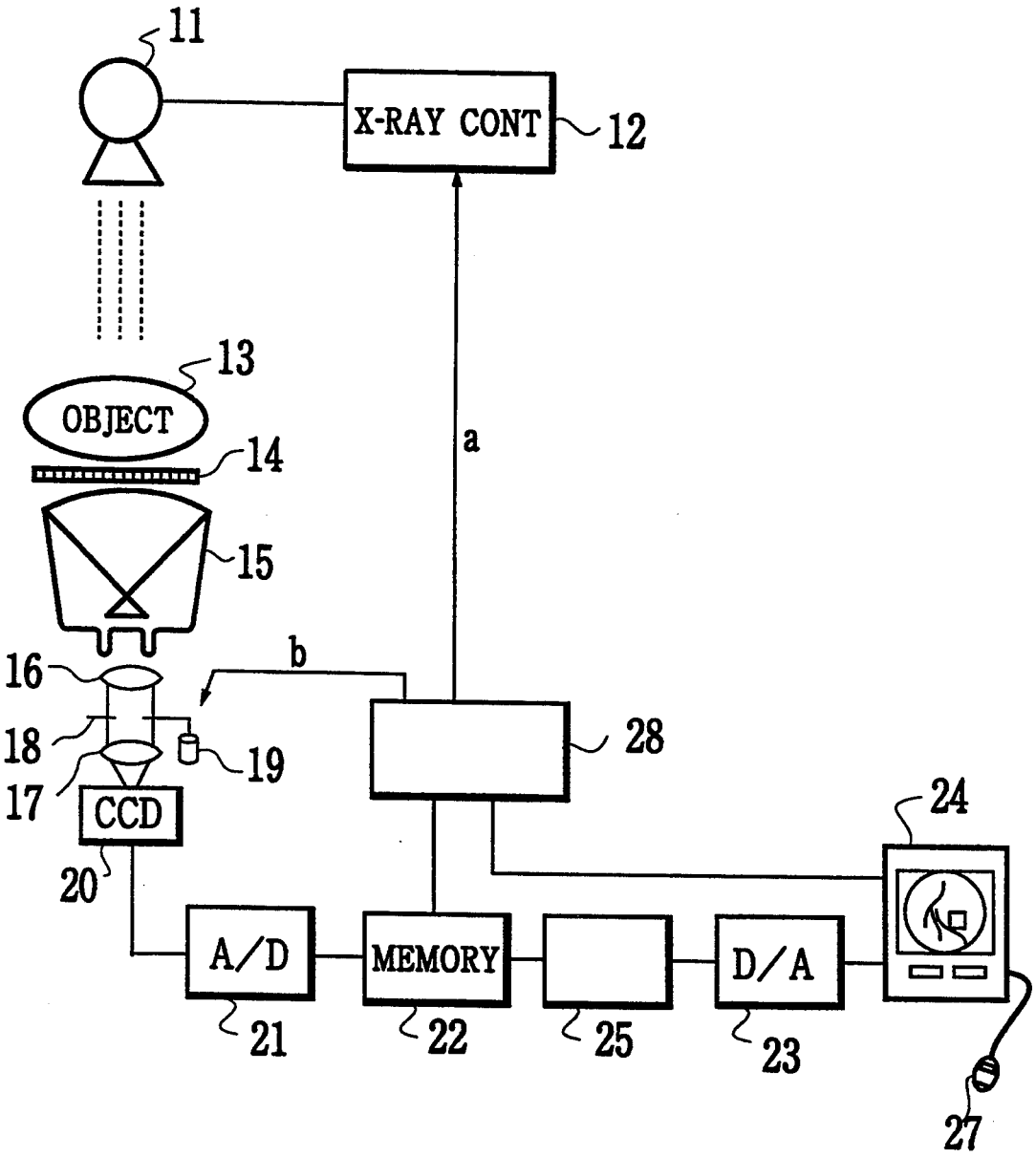
FIG. 1 is a block diagram showing a first embodiment of the X-ray diagnostic apparatus according to the present invention.

In FIG. 1, the X-ray diagnostic apparatus comprises an X-ray tube 11, an X-ray controller 12, a grid 14, an image intensifier 15, an optical system 16, 17 and 18, a diaphragm motor 19, a CCD (charge coupled device) 20, an A/D convertor 21, a memory 22, a D/A convertor 23, an image monitor 24, an image signal processing section 25, an interest region determining means (mouse) 27, and luminous energy control means 28.

The X-ray tube 11 generates X-rays. The X-ray controller 12 controls a dose of the X-rays generated by the X-ray tube 11. The image intensifier 15 receives the X-rays radiated by the X-ray tube 11 and passed through an object 13 to be diagnosed and converts the received X-rays into an optical image. The optical system is composed of two lenses 16 and 17 and an optical diaphragm 18 disposed between two lenses 16 and 17. The diaphragm motor 19 drives the optical diaphragm 16. The CCD 20 transduces an optical image obtained through the optical system into electric signals in accordance with the Knee characteristics such that the photoelectric transduction characteristics into the electric signals has a point of inflection beyond which the gradient thereof is reduced. The A/D convertor 21 converts analog signals of the CCD 20 into digital signals. The memory 22 stores the digital signals outputted by the A/D convertor 21. The image processing section 25 processes the digital signals read out of the memory 22 appropriately. The D/A convertor 23 converts the digital signals processed by the image processing section 25 into analog signals again. The image monitor (image display unit) 24 displays an image (diagnosis information) of an object 13 to be diagnosed. The interest region determining means 27 determines any required image region of interest in the displayed image.

The luminous energy control means 28 controls the aperture of the optical diaphragm 18 and/or a dose of X-rays radiated upon the object 13 on the basis of the values at pixels of the CCD in a determined image region of interest in such a way that the values on the photoelectric transduction characteristics are always kept below the point of inflection.

In operation, when the X-rays radiated by the X-ray tube 11 is passed through an object (patient) 13 to be diagnosed, the X-rays are absorbed in accordance with X-ray absorption characteristics of sites (e.g., bone, muscle, etc.), so that it is possible to obtain an image reflective of change in the X-rays. The excessive X-rays scattered by the object 13 without contribution to the image formation are removed through the grid 14 before Introduced into the image intensifier 15. The image intensifier 15 converts the X-rays passed through the object into image signals and amplifies the converted image signals as an optical image. The optical image outputted by the image intensifier 15 is passed through the two lenses 16 and 17 and then focused onto the CCD 20 to transduce the optical image into electric signals. In this CCD 20, when light of a high luminous energy is allowed to be incident upon the CCD 20, since the light intensity exceeds the capacity of the photoelectric transduction section, it is impossible to read the transduced electric signals as image signals even if processed. In contrast, when light of a low luminous energy is allowed to be incident upon the CCD 20, since noise increases due to lack of light intensity, it is also impossible to derive reliable image signals. In other words, the CCD 20 is provided with an appropriate luminous energy (light intensity) range In which transduced charges are not overflowed and further noise level is low. To control the luminous energy of light allowed to be incident upon the CCD 20, the X-ray controller 12 controls a dose of the X-rays radiated by the X-ray tube 11, so that the luminous energy of light outputted by the image intensifier 15 can be controlled. In this embodiment, since the optical diaphragm 18 is provided, it is also possible to control the luminous energy of light allowed to be incident upon the CCD 20 by controlling the aperture rate of the optical diaphragm 18 with the use of the diaphragm drive motor 19 so that a constant radiant energy of the X-rays can be obtained. Further, it is of course possible to control both the dose of the X-rays and the aperture rate of the optical diaphragm 18 simultaneously.

Figure 2:
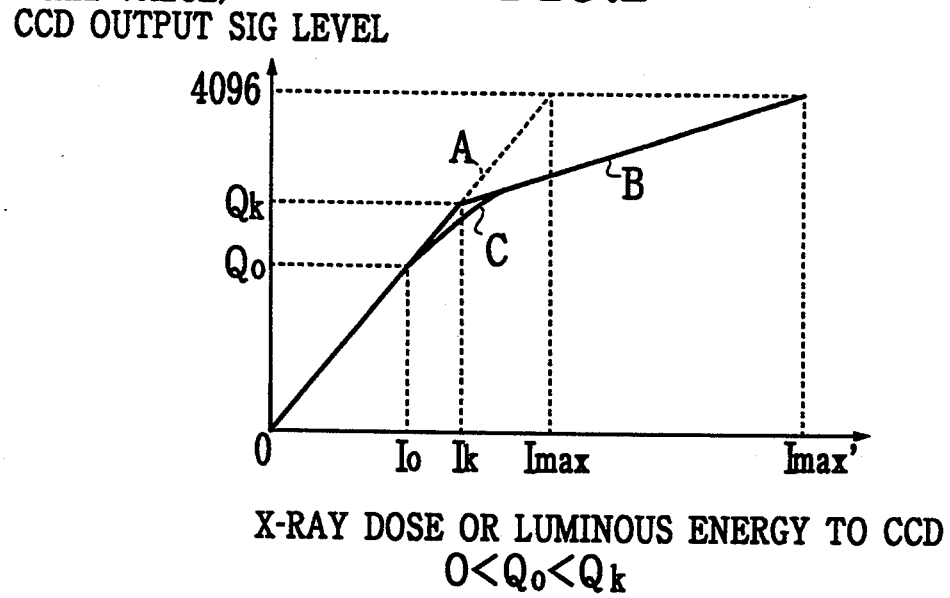
FIG. 2 is a graphical representation showing Knee characteristics of a CCD shown in FIG. 1.

In the CCD 20, the light is transduced into charges and further the transduced charges are transferred and read in sequence as electric signals. In general, the photoelectric transduction characteristics of the CCD 20 are linear. In this embodiment, however, the photoelectric transduction characteristics of the CCD 20 is so controlled as to have the Knee (two-stage gain) characteristics in response to the luminous energy of incident light. That is, the gain of the CCD changes linearly at a relatively sharp gradient to a point of inflection but at a relatively gentle gradient beyond the inflection point, with increasing luminous energy of light allowed to be incident upon the CCD. In more detail, FIG. 2 shows the input-output characteristics of the CCD, in which the input is the luminous energy of the incident light upon the CCD and the output is the output signal level at the pixel. In the drawing, when the luminous energy of light allowed to be incident upon the CCD is low, the CCD output signal level at each pixel increases in accordance with a linear curve A. However, when the luminous energy of light allowed to be incident upon the CCD is high beyond the inflection point ($I_k$, $Q_k$) (referred to as Knee point), the CCD output signal level at each pixel increases in accordance with the other linear curve B. Further, the above-mentioned Knee point can be controlled as described later. The outputted analog signals of the CCD 20 are converted into digital signals by the A/D convertor 21, stored in the memory 22, processed by the image processing section 25, returned again into the analog signals by the D/A convertor 23, and then displayed on the display monitor 24.

In this embodiment, further, since the interest region determining means 27 such as a mouse (pointing device) is provided for pointing out any required image position, it is possible to determine any region of interest (referred to as ROI) to be noticed. Further, it is possible to control the image so as to become most clear for the observer, by setting the average brightness (average pixel value) at a ROI to a constant value with the use of the luminous energy control means 28. In more detail, the luminous energy control means 28 reads digital data at the ROI from the memory 22 on the basis of the position and the area of the ROI designated by the pointing device (mouse) 27, calculates an average value thereof, and controls the luminous energy of light incident upon the CCD so that the averaged value matches the digital data $Q_0$ corresponding to a pixel value on the basis of which the diagnosis image can be seen clearly on the display monitor 24.

In more detail, when the average value at the ROI is lower than $Q_0$, the luminous energy control means 28 transmits a control signal for increasing the dose (radiant energy) of X-rays to the X-ray controller 12 so that the X-ray tube 11 can increase the dose of the X-rays. In contrast wit this, when the average value at the ROI is higher than $Q_0$, the luminous energy control means 28 transmits another control signal for decreasing the dose of X-rays to the X-ray controller 12 so that the X-ray tube 11 can be decrease the dose of the X-rays. Accordingly, it is possible to operate the diagnostic apparatus under the condition that the average value at the ROI always matches the appropriate output level of the CCD (the pixel value) $Q_0$.

Alternatively, it is also possible to match the average value at the ROI with $Q_0$, when the luminous energy control means 28 controls the aperture rate of the optical diaphragm 18 while keeping the dose of the X-rays at a constant level. In this control, the luminous energy control means 28 outputs a control signal for controlling the aperture of the optical diaphragm 18 to a control mechanism (not shown) of the diaphragm drive motor 19. Further, it is of course possible to control both the dose of X-rays and the aperture rate of the optical diaphragm simultaneously by the luminous energy control means 28.

FIG. 2 shows the Knee characteristics of the CCD 20. In the case where the CCD 20 is not provided with the Knee characteristics (as shown by a dashed line A), only when the luminous energy of the light allowed to be incident upon the CCD and then read out as the image data lies between 0 and $I_{max}$, the image can be seen clearly on the display monitor 24. On the other hand, however, when the luminous energy of the light allowed to be incident upon the CCD is higher than $I_{max}$, halation will occur. In contrast with this, in the case where the CCD 20 is provided with the Knee characteristics (as shown by two solid lines A and B)

having a Knee point ($I_k$, and $Q_K$) at an intersection between the two lines A and B, since the luminous energy of light allowed to be incident upon the CCD and read out as image data can be widened between 0 and $I_{max'}$, the occurrence of halation can be prevented effectively. In this case, the image contrast is high in the range between 0 and $I_k$ but low in the range between $I_k$ and $I_{max'}$.

When the CCD provided with the above-mentioned Knee characteristics is used, the diagnostic apparatus of the present invention is effective when only the ROI is diagnosed and there exist no diagnostic information in the other range. However, in general, although the essential diagnostic information resides in the ROI, the other image information other than the ROI is also often required for the diagnosis. In this case, the importance at regions other than the ROI differs according to the diagnosed sites or the diagnosis object. In the case where the importance is high at another higher brightness region other than the ROI, it is possible to improve the contrast in the important higher brightness region, by lowering the Knee point $I_k$ by the luminous energy control means 28. On the other hand, when the importance is low at the higher brightness region other than the ROI, it is possible to widen the important low brightness region by raising the Knee point $I_k$ by the luminous energy control means 28. In other words, when the Knee points $I_k$ is determined according to the diagnosed sites and the diagnosis objects, it is possible to use the diagnostic apparatus more properly according to the occasions.

As described above, the position of the Knee point ($Q_K$ in the pixel value) can be adjusted according to the diagnosis cases. On the other hand, the pixel value $Q_0$ corresponding to the appropriate monitor brightness easy to see is always constant. Therefore, there exists a possibility that the Knee point $Q_k$ becomes lower than $Q_0$. When the Knee point $Q_k$ becomes lower than $Q_0$, the halation is not only prevented effectively, but also the contrast at the ROI is deteriorated.

To overcome this problem, that is, to prevent the Knee point $Q_0$ from being lowered below $Q_0$, the luminous energy control means 28 always adjusts the pixel value $Q_0$ automatically so as to become lower than $Q_k$. For instance, one of the adjustment method thereof is as follows: a constant Q1 is previously determined, and the pixel value $Q_0$ is determined automatically as if $Q1 < Q_k - A$, $Q_0 = Q1$ if $Q1 \geqq Q_k - A$, $Q_0 = Q_k - A$ where Q1 denotes the pixel value corresponding to the optimum monitor brightness when the Knee characteristics are not used, and A denotes a constant value.

Further, another method thereof is as follows: the pixel value $Q_0$ is determined automatically as $$Q_0 = B * Q_k$$

where B denotes a constant smaller than 1, and * denotes the multiplication.

As described above, in any methods, it is possible to determine the pixel value $Q_0$ so as to be become lower than $Q_k$.

As described above, in the diagnostic apparatus according to the present Invention, it is possible to prevent the halation on the monitor image without deteriorating the contrast in a region important for diagnosis.

A modification of the above-mentioned first embodiment will be described hereinbelow. In this modification, the CCD 20 is provided with the Knee characteristics in which the two linear characteristic lines A and B are connected by another smooth curve C near the point of inflection (Knee point), also as shown in FIG. 2. In this case, the Knee point ($I_k$, $Q_k$) is determined at an intersection of two extrapolation lines of the two linear characteristics A and B. In this modification, the Knee point ($I_k$, $Q_k$) can be controlled by the luminous energy control means 28 in quite the same way as with the case of the first embodiment.

Further, in the above-mentioned embodiment, the CCD is used as the image forming device provided with the Knee characteristics, this is because it is possible to easily obtain the Knee characteristics on the basis of the CCD characteristics. Without being limited only to the CCD, however, any image forming devices other than the CCD can be used as far as the Knee characteristics can be obtained. For instance, even if an image tube camera is used, it is possible to obtain the Knee characteristics by processing the output signals of the image tube camera through a processing circuit so as to provide the Knee characteristics for the image tube camera.

Figure 4A:
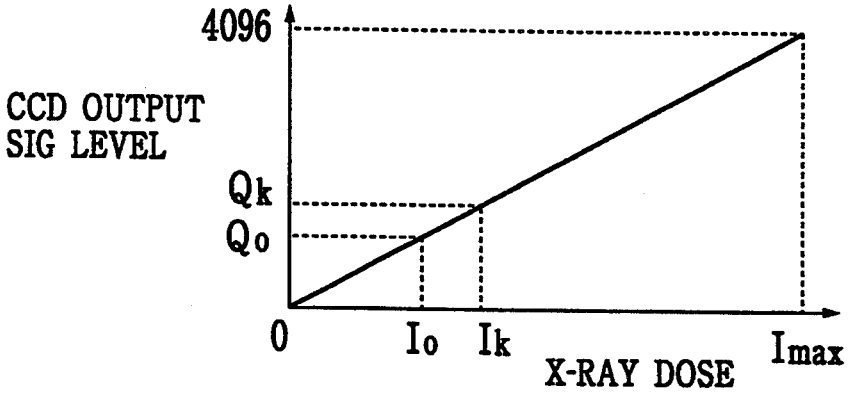
FIG. 4A is a graphical representation showing the transduction characteristics of the CCD provided for the X-ray diagnostic apparatus shown in FIG. 3.
Figure 4B:
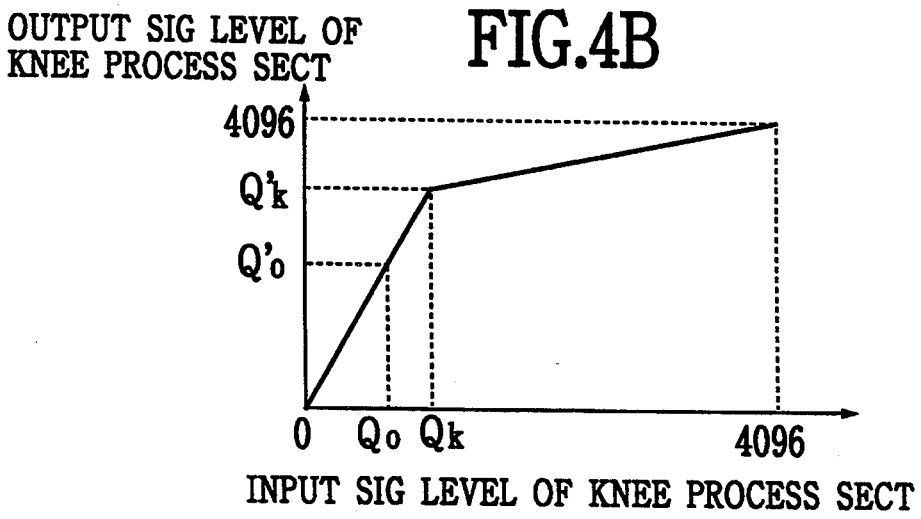
FIG. 4B is a graphical representation showing input/output characteristics of a Knee characteristics processing section provided for the X-ray diagnostic apparatus shown in FIG. 3.
Figure 3:
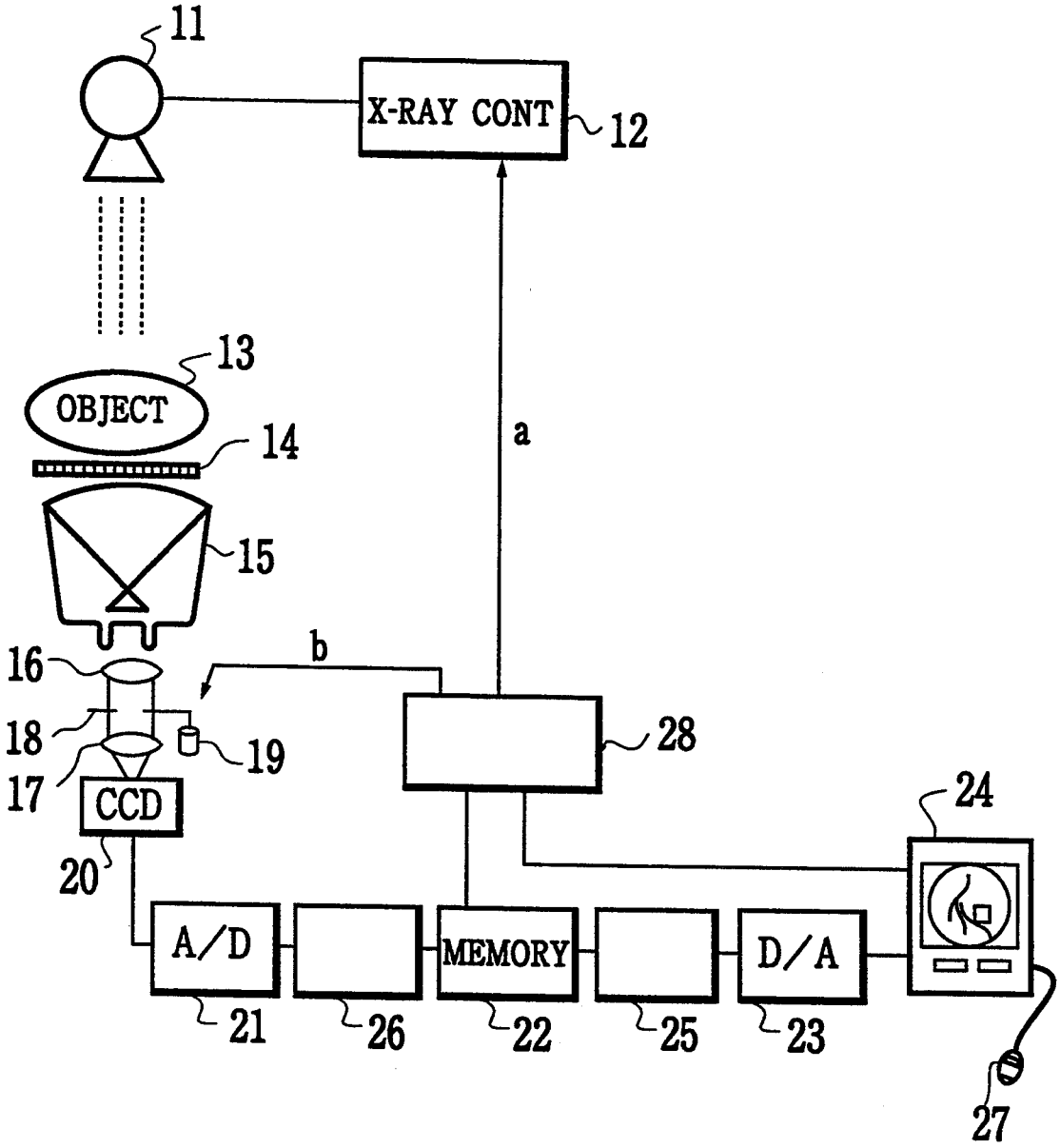
FIG. 3 is a block diagram showing a second embodiment of the X-ray diagnostic apparatus according to the present invention.

FIG. 3 shows a second embodiment of the diagnostic apparatus according to the present invention, in which the same reference numerals have been retained for similar parts or elements which have the same functions as with the case of the first embodiment shown in FIG. 1, without repeating the description thereof. In this embodiment, the CCD 20 is provided with the linear characteristics (having no Knee characteristics) as shown in FIG. 4A. Instead of this, however, a Knee characteristic processing section 26 for processing digital image signals inputted thereto in accordance with the Knee characteristics as shown in FIG. 4B is additionally interconnected between the A/D convertor 21 and the memory 22, as shown in FIG. 3. In FIG. 4B, the abscissa represents the input signal level of the Knee characteristic processing section 25 and the ordinate represents the output signal level of the same processing section 25. In FIG. 4B, the Knee point can be represented by the coordinates ($Q_k$, $Q_{k'}$). In this second embodiment, the Knee point can be also controlled in quite the same way as with the case of the first embodiment, in order to prevent the occurrence of halation on the monitor image.

What is claimed is:

1. An X-ray diagnostic apparatus comprising:

an X-ray tube;

an X-ray controller for controlling a dose of X-rays generated by said X-ray tube;

an image intensifier for converting X-rays radiated by said X-ray tube and passed through an object to be diagnosed, into an optical image;

an optical system through which the optical image is passed;

an image forming device for transducing the optical image obtained through said optical system into electric signals, said image forming device being provided with Knee characteristics such that photoelectric transduction characteristics into the electric signals has a point of inflection beyond which gradient thereof is reduced;

a memory device for storing the electric signals outputted by said image forming device;

an image displaying unit for processing the electric signals of said memory device for display of diagnosis information of the object to be diagnosed;

interest region determining means for determining a region of interest with respect to the diagnosis information displayed on said image display unit; and luminous energy control means for controlling the dose of the X-rays through said X-ray controller on the basis of pixel values of said image forming device obtained in the determined region of interest, in such a way that values on the photoelectric transduction characteristics are always kept lower than a value at the point of inflection.

2. An X-ray diagnostic apparatus comprising:

an X-ray tube;

an X-ray controller for controlling a dose of X-rays generated by said X-ray tube;

an image intensifier for converting X-rays radiated by said X-ray tube and passed through an object to be diagnosed, into an optical image;

an optical system having an optical diaphragm, through which the optical image is passed;

an image forming device for transducing the optical image obtained through said optical system into electric signals, said image forming device being provided with Knee characteristics such that photoelectric transduction characteristics into electric signals has a point of inflection beyond which gradient thereof is reduced;

a memory device for storing the electric signals outputted by said image forming device;

an image displaying unit for processing the electric signals of said memory device for display of diagnosis information of the object to be diagnosed;

interest region determining means for determining a region of interest with respect to the diagnosis information displayed on said image display unit; and luminous energy control means for controlling luminous energy of light incident upon said image forming device through the optical diaphragm on the basis of pixel values of said image forming device obtained in the determined region of interest, in such a way that values on the photoelectric transduction characteristics are always kept lower than a value at the point of inflection.

3. An X-ray diagnostic apparatus comprising:

an X-ray tube;

an X-ray controller for controlling a dose of X-rays generated by said X-ray tube;

an image intensifier for converting X-rays radiated by said X-ray tube and passed through an object to be diagnosed, into an optical image;

an optical system having an optical diaphragm, through which the optical image is passed;

an image forming device for transducing the optical image obtained through said optical system into electric signals, said image forming device being provided with Knee characteristics such that photoelectric transduction characteristics into electric signals has a point of inflection beyond which gradient thereof is reduced;

a memory device for storing the electric signals outputted by said image forming device;

an image displaying unit for processing the electric signals of said memory device for display of diagnosis information of the object to be diagnosed;

interest region determining means for determining a region of interest with respect to the diagnosis information displayed on said image display unit; and luminous energy control means for controlling the dose of the X-rays through said X-ray controller and further luminous energy of light incident upon said image forming device through the optical diaphragm on the basis of pixel values of said image forming device obtained in the determined region of interest, in such a way that values on the photoelectric transduction characteristics are always kept lower than a value at the point of inflection.

4. The X-ray diagnostic apparatus of any of claim 1, 2 or 3, wherein said image forming device is provided with Knee characteristics such that the photoelectric transducing characteristics are linear and has a point of inflection beyond which the gradient thereof is reduced.

5. The X-ray diagnostic apparatus of any of claim 1, 2 or 3, wherein said image forming device is provided with Knee characteristics such that the photoelectric transduction characteristics are connected by a smooth curve near the point of inflection.

6. The X-ray diagnostic apparatus of any of claim 1, 2 or 3, wherein said image forming device is a charge coupled device.

7. The X-ray diagnostic apparatus of any of claim 1, 2 or 3, wherein said interest region determining means is a mouse.

8. An X-ray diagnostic apparatus comprising:

an X-ray tube;

an X-ray controller for controlling a dose of X-rays generated by said X-ray tube;

an image intensifier for converting X-rays radiated by said X-ray tube and passed through an object to be diagnosed, into an optical image;

an optical system through which the optical image is passed;

an image forming device for transducing the optical image obtained through said optical system into electric signals;

a Knee characteristic processing section for providing Knee characteristics such that input/output characteristics thereof has a point of inflection beyond which gradient thereof is reduced, to the electric signals outputted by said image forming means;

a memory device for storing the electric signals outputted by said Knee characteristic processing section;

an image displaying unit for processing the electric signals of said Knee characteristic processing section for display of diagnosis information of the object to be diagnosed;

interest region determining means for determining a region of interest with respect to the diagnosis information displayed on said image display unit; and luminous energy control means for controlling the dose of the X-rays through said X-ray controller on the basis of pixel values of said image forming device obtained in the determined region of interest, in such a way that values of the electric signals to which the Knee characteristics are provided are always kept lower than a value at the point of inflection.

9. An X-ray diagnostic apparatus comprising:

an X-ray tube;

an X-ray controller for controlling a dose of X-rays generated by said X-ray tube;

an image intensifier for converting X-rays radiated by said X-ray tube and passed through an object to be diagnosed, into an optical image;

an optical system having an optical diaphragm, through which the optical image is passed;

an image forming device for transducing the optical image obtained through said optical system into electric signals;

a Knee characteristic processing section for providing Knee characteristics such that input/output characteristics thereof has a point of inflection beyond which gradient thereof is reduced, to the electric signals outputted by said image forming means;

a memory device for storing the electric signals outputted by said Knee characteristic processing section;

an image displaying unit for processing the electric signals of said Knee characteristic processing section for display of diagnosis information of the object to be diagnosed;

interest region determining means for determining a region of interest with respect to the diagnosis information displayed on said image display unit; and luminous energy control means for controlling luminous energy of light incident upon said image forming device through the optical diaphragm on the basis of pixel values of said image forming device obtained in the determined region of interest, in such a way that values of the electric signals to which the Knee characteristics are provided are always kept lower than a value at the point of inflection.

10. An X-ray diagnostic apparatus comprising:

an X-ray tube;

an X-ray controller for controlling a dose of X-rays generated by said X-ray tube;

an image intensifier for converting X-rays radiated by said X-ray tube and passed through an object to be diagnosed, into an optical image;

an optical system having an optical diaphragm, through which the optical image is passed;

an image forming device for transducing the optical image obtained through said optical system into electric signals;

a Knee characteristic processing section for providing Knee characteristics such that input/output characteristics thereof has a point of inflection beyond which gradient thereof is reduced, to the electric signals outputted by said image forming means;

a memory device for storing the electric signals outputted by said Knee characteristic processing section;

an image displaying unit for processing the electric signals of said Knee characteristic processing section for display of diagnosis information of the object to be diagnosed;

interest region determining means for determining a region of interest with respect to the diagnosis information displayed on said image display unit; and luminous energy control means for controlling the dose of the X-rays through said X-ray controller and further luminous energy of light incident upon said image forming device through the optical diaphragm on the basis of pixel values of said image forming device obtained in the determined region of interest, in such a way that values of the electric signals to which the Knee characteristics are provided are always kept lower than a value at the point of inflection.

11. The X-ray diagnostic apparatus of any of claim 8, 9 or 10, wherein said Knee characteristic processing section is provided with Knee characteristics such that the input/output characteristics are linear and has a point of inflection beyond which the gradient thereof is reduced.

12. The X-ray diagnostic apparatus of any of claim 8, 9 or 10, wherein said Knee characteristic processing section is provided with Knee characteristics such that the input/output characteristics are connected by a smooth curve near the point of inflection.

* * * * *